US007165544B2

(12) United States Patent
Bachinski et al.

(10) Patent No.: US 7,165,544 B2
(45) Date of Patent: Jan. 23, 2007

(54) TOUCH SWITCH SYSTEM FOR A FIREPLACE

(75) Inventors: Thomas J. Bachinski, Lakeville, MN (US); Brynn Douglas Rogers, Excelsior, MN (US); David J. Oja, Burnsville, MN (US)

(73) Assignee: HNI Technologies Inc., Muscatine, IA (US)

( * ) Notice: Subject to any disclaimer, the term of this patent is extended or adjusted under 35 U.S.C. 154(b) by 260 days.

(21) Appl. No.: 10/384,407

(22) Filed: Mar. 6, 2003

(65) Prior Publication Data

US 2004/0011352 A1 Jan. 22, 2004

Related U.S. Application Data

(63) Continuation-in-part of application No. 10/199,983, filed on Jul. 19, 2002, now Pat. No. 6,748,942.

(51) Int. Cl.
*F24C 3/12* (2006.01)
*F24B 1/187* (2006.01)

(52) U.S. Cl. ..... 126/512; 126/503

(58) Field of Classification Search ..... 126/512, 126/503, 502, 39 BA; 219/506; 700/90; 200/600
See application file for complete search history.

(56) References Cited

U.S. PATENT DOCUMENTS 4,149,217 A 4/1979 Tucker
4,391,265 A 7/1983 Chen
4,894,493 A * 1/1990 Smith et al. ..... 200/600
4,962,750 A * 10/1990 Bridgewater ..... 126/503
4,971,030 A * 11/1990 Thow et al. ..... 126/512
5,033,454 A 7/1991 Smith
5,153,572 A * 10/1992 Caldwell et al. ..... 345/174
5,235,217 A * 8/1993 Kirton ..... 307/326
5,241,463 A * 8/1993 Lee ..... 700/90
5,450,841 A * 9/1995 Whitaker et al. ..... 126/512
5,575,274 A * 11/1996 DePalma ..... 126/512
5,663,633 A 9/1997 Kahn et al.
5,938,425 A 8/1999 Damrath et al.
5,941,237 A * 8/1999 Shimek et al. ..... 126/512
6,027,823 A * 2/2000 Schmitt ..... 428/621
6,361,725 B1 * 3/2002 Sinsley ..... 264/87
6,378,516 B1 * 4/2002 Blount ..... 126/512
6,748,942 B1 * 6/2004 Bachinski et al. ..... 126/512

FOREIGN PATENT DOCUMENTS

EP 0 729 292 A1 * 8/1996
JP 60-188754 A * 9/1985

OTHER PUBLICATIONS

"TSI Touch Switch Kit," http://www.ramseyelectronic-s.com/cgi–bin/commerce.exe?preadd=action&key=TSI, 1 page, date printed Jul. 17, 2002.
"Touch Switches," http:// www.paia.com/touchsw.htm, 4 pages, date printed Jul. 17, 2002.

* cited by examiner

*Primary Examiner*—Josiah C. Cocks
(74) *Attorney, Agent, or Firm*—Faegre & Benson LLP

(57) ABSTRACT

A fireplace including a burner disposed to combust a combustible gas and air mixture within a combustion chamber. An exposed panel defining an exposed surface. A touch portion of the exposed surface isolated from heat generated within the combustion chamber to reduce a temperature of the touch portion. A control circuit coupled to the touch portion. The control circuit monitoring the touch portion and driving a component of the fireplace in response to a change at the touch portion.

4 Claims, 3 Drawing Sheets

TOUCH SWITCH SYSTEM FOR A FIREPLACE

This application is a continuation-in-part of application Ser. No. 10/199,983, filed Jul. 19, 2002 now U.S. Pat. No. 6,748,942, and which is incorporated herein by reference.

TECHNICAL FIELD

The present invention relates to fireplaces. More particularly, the invention relates to a touch switch system for a fireplace.

BACKGROUND

Fireplaces have become increasingly commonplace in homes, businesses, and other buildings. A fireplace provides benefits including the generation of heat as well as an aesthetically-pleasing arrangement of flames, sounds, and smells. A gas fireplace is typically mounted in a wall of a structure and includes a switch for starting the fireplace and generating flames. A gas fireplace is typically turned on and off by throwing the switch, which is located behind an access panel located at the bottom of the fireplace.

However, gaining access to the fireplace creates several problems. For example, a person accessing the switch has to bend over, raise the access panel, and then turn or flip the switch to the desired position. In addition, because the fireplace produces heat, it is possible for one or more exterior surfaces of the fireplace to become heated. These exterior surfaces of the fireplace also pose a risk of burns to individuals or damage to objects that come into contact with the surfaces during operation of the switch located at the bottom of the fireplace. Other current fireplace designs remotely locate a switch from the fireplace. This may make it difficult for a user to identify the switch that actually operates the fireplace. Yet, other fireplace designs include toggle or push button switches located on the fireplace that can get hot, are noticeable, and, often, not as visually appealing to a person viewing the fire. Current fireplace designs fail to provide an easy, safe, and appealing system or method for turning the fireplace on and off.

Thus, there is a need for a fireplace that allows for a safe and easy switching of the fireplace from off and on positions, or for controlling other features of the fireplace.

SUMMARY

Generally, the present invention relates to fireplaces. More particularly, the invention relates to apparatus and method for switching fireplace components on and off, or altering that state of fireplace component.

In one aspect, the invention relates a gas fireplace including a burner disposed to combust a combustible gas and air mixture within a combustion chamber, an exposed panel, wherein the exposed panel defines an exposed surface, a touch portion of the exposed surface, wherein the touch portion is isolated from heat generated within the combustion chamber to reduce a temperature of the touch portion, a gas valve, and a control circuit coupled to the touch portion and gas valve, wherein the control circuit monitors the touch portion and controls the opening and closing of the gas valve in response to a change at the touch portion.

In another aspect, the invention relates to a method for turning a gas fireplace on and off including: providing a touch portion of an exposed surface of the fireplace; coupling the touch portion to a control circuit; monitoring the voltage at the touch portion; and turning the fireplace on or off in response to a voltage change at the touch surface.

In another aspect, the invention relates to a gas fireplace including a burner disposed to combust a combustible gas and air mixture within a combustion chamber, an exposed panel, wherein the exposed panel defines an exposed surface, a touch portion of the exposed surface, wherein the touch portion is isolated from heat generated within the combustion chamber to reduce a temperature of the touch portion, and a control circuit coupled to the touch portion, wherein the control circuit monitors the touch portion and drives a component of the fireplace in response to a change at the touch portion.

In yet another aspect, the invention relates to a combustion chamber enclosure defining a combustion chamber in which combustion occurs and heat is generated, an exposed panel positioned adjacent the combustion chamber, wherein the exposed panel is heated by the combustion within the combustion chamber, a touch portion defined as a portion of the exposed panel, wherein the touch portion is isolated from the heat generated within the combustion chamber to reduce a temperature of the touch portion, a gas valve, and a control circuit coupled to the touch portion and gas valve, wherein the control circuit monitors the touch portion and modulates the gas valve in response to a change measured at the touch portion.

The above summary of the present invention is not intended to describe each disclosed embodiment or every implementation of the present invention. Figures in the detailed description that follow more particularly exemplify embodiments of the invention. While certain embodiments will be illustrated and described, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternant forms, specifics thereof have been shown by way of example and the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

The invention is applicable to a combustible gas fireplace or other fireplaces. In particular, the invention is directed to a touch switch apparatus for turning a fireplace on and off, or, for controlling other functions of the fireplace. While the present invention is not so limited, an appreciation of the various aspects of the invention will be gained through a discussion of the examples provided below.

Embodiments of the present invention may be used in conjunction with any system or apparatus that ignites a combustible gas to generate a gas flame or any other heat generating fireplace. A non-exhaustive list of such devices may include fireplaces, grills, stoves etc. While the example embodiments of the present invention provided below are described in conjunction with an example fireplace, the present invention is equally applicable to other systems or apparatuses besides a fireplace that ignite a combustible gas to generate a gas flame.

As used herein, the term "coupled" means any structure or method that may be used to provide connectivity between two or more elements, which may or may not include a direct physical connection between the elements. The terms "exposed panel" and "exposed surface" mean any panel or surface of the fireplace or other device that is heated by heat generated by the fireplace and that is accessible by the operator or user of the fireplace following installation. The phrase "combustion chamber enclosure" may include any enclosure in which flames and/or heat are generated or simulated.

Figure 1:
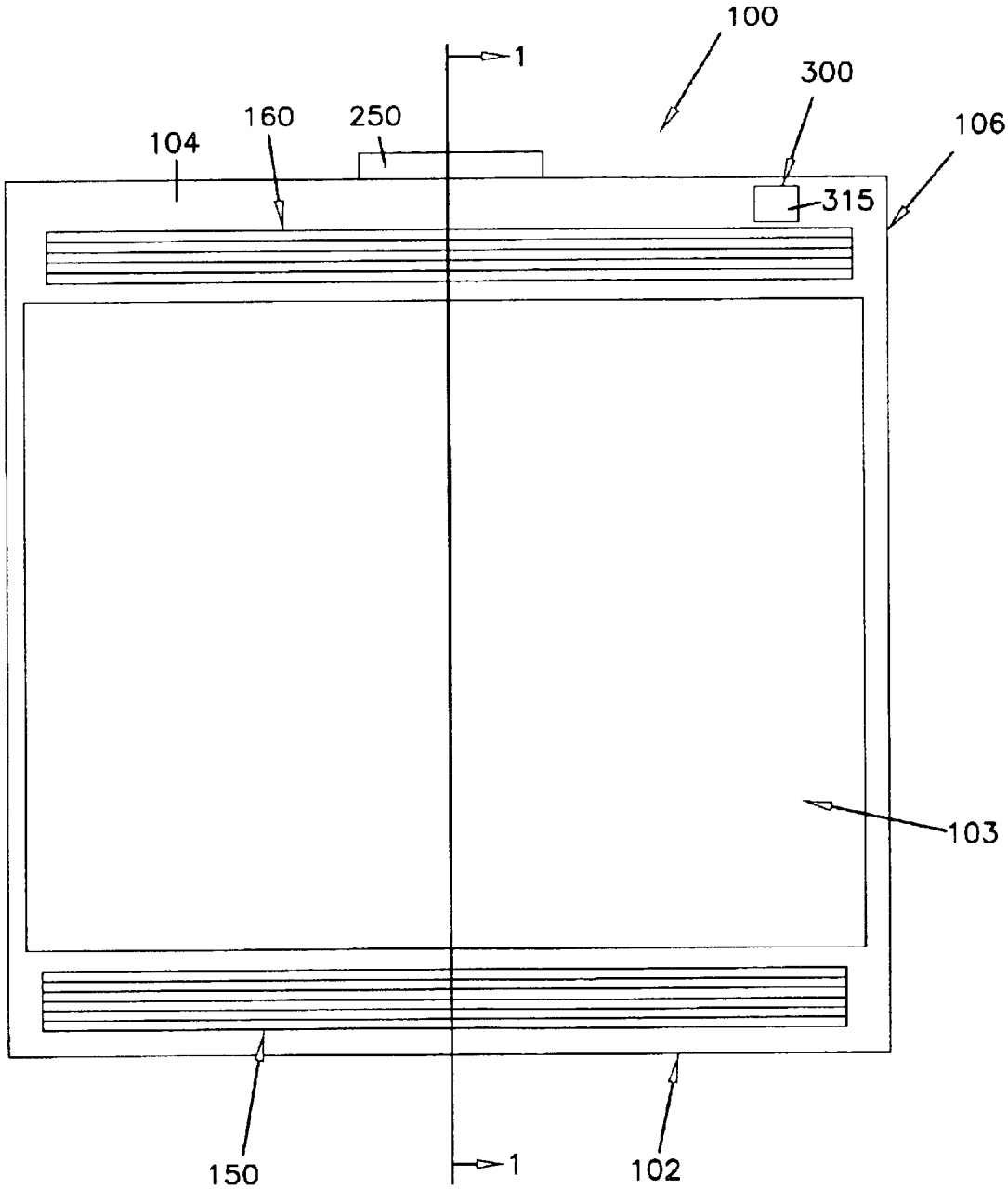
FIG. 1 is a front view of an example fireplace including a first example embodiment of a touch switch system made in accordance with the present invention.
Figure 2:
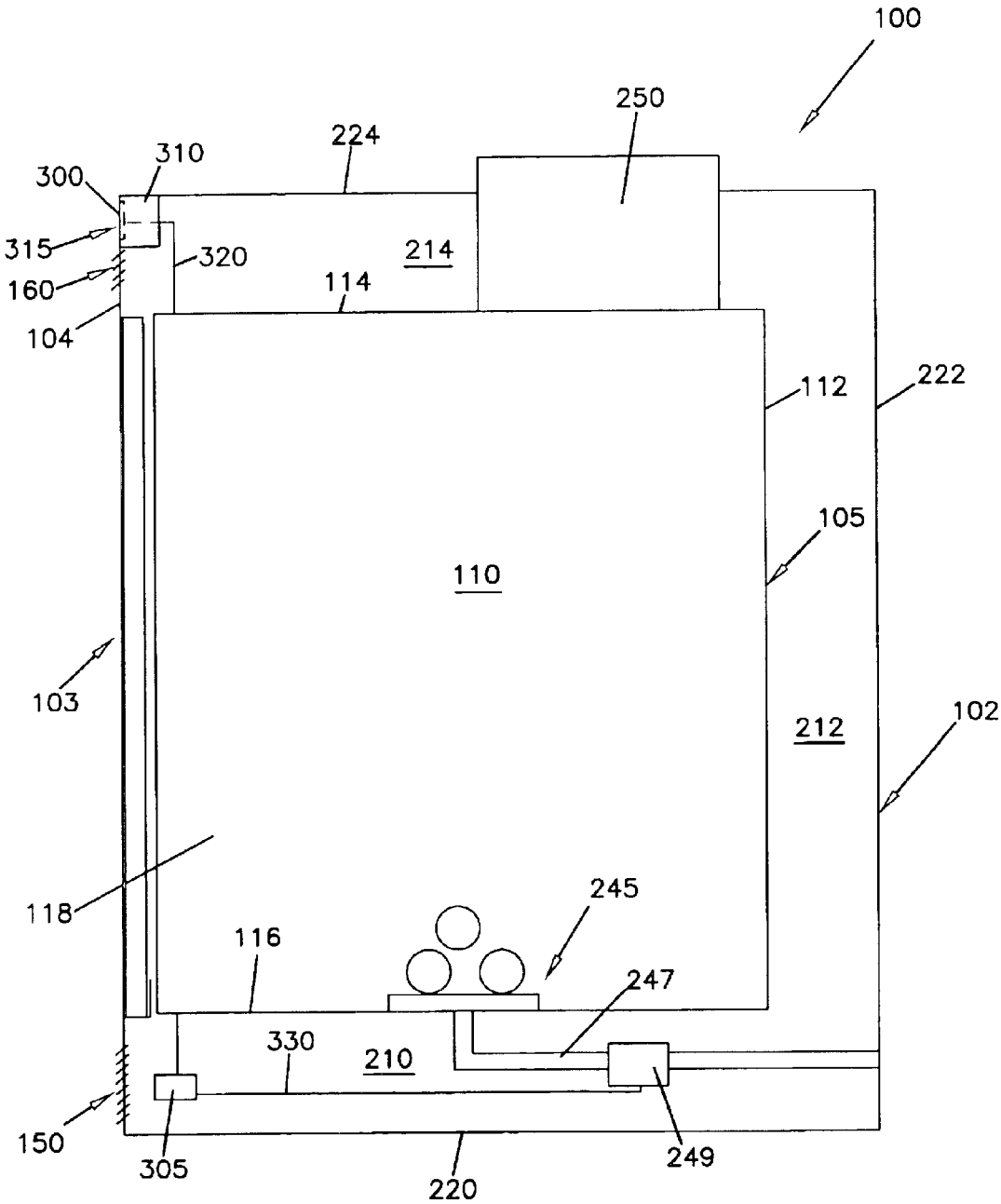
FIG. 2 is a cross-sectional view of the fireplace shown in FIG. 1 illustrating additional components comprising the example embodiment of the touch switch system.

Referring to FIGS. 1 and 2, front and cross-sectional views of an example embodiment of a fireplace 100 are shown. Fireplace 100 is illustrated including an outer enclosure 102, a front panel 103, grills 150 and 160, and a combustion chamber enclosure 105. The combustion chamber enclosure 105 comprises front panel 103 and panels 112, 114, 116, and 118 that together with a second side panel (not shown) define a combustion chamber 110. The fireplace 100 may generally function to ignite combustible gas provided from a combustible gas source to create a gas flame. Alternatively, a simulated electric fireplace may be constructed within the outer enclosure 102. The simulated electric fireplace can include several electrical components such as a simulated ember bed, lights, fans, blowers, and motors.

Grills 150 and 160 cover a room air intake and room air exhaust, respectively. Fireplace 100 includes a lower plenum 210, a rear plenum 212, and a top plenum 214 positioned between outer panels 220, 222, and 224 and the combustion chamber enclosure 105. The plenums 210, 212, and 214 are fluidly connected to one another and define a plenum system through which room air may enter the lower plenum 210 through the grill 150, circulate through the rear and top plenums 212 and 214, and exit through the grill 160 back into the room. The room air may be heated as it travels through the plenum system. Optionally, a blower can be used for blowing room air through the plenums of the fireplace 100.

FIGS. 1 and 2 show fireplace 100 in one configuration. Other configurations are also possible. For example, the present invention may be applicable to any prefabricated gas fireplace such as a direct vent, a universal vent, a B-vent, a horizontal/vertical-vent, a dual direct vent, or a multisided unit. The present invention may also be applicable to other combustible gas fireplace systems, as noted above, as well as any other fireplace that generates heat such as a simulated electric fireplace or solid fuel burning fireplace.

A burner 245 is shown positioned in the combustion chamber enclosure 105 to combust gas and thereby generate heat. Alternatively, the burner can be positioned so that its top surface is even with or position below panel 116. The burner 245 is coupled by a gas line 247 to a source of combustible gas (not shown). A gas valve 249 that can be opened and closed to regulate or modulate the flow of combustible gas and either turn the combustion within the fireplace 100 on or off can be couple to the gas line 247.

The heat generated by the burner 245 causes the transfer of heat to an exposed panel of the fireplace 100. The exposed panel of fireplace 100 is front panel 103. Alternatively, any panel or other structure of the fireplace may include an exposed surface. For example, a multisided fireplace unit may include two or more exposed panels. In other alternative embodiments, the exposed panel can be located adjacent to the combustion chamber.

Front panel 103 defines an exposed surface 104. As the fireplace 100 generates heat, the exposed surface 104 is also heated. Often, the exposed surface 104 is heated to a temperature that can cause injury to an individual who touches the surface unless all or a portion of the exposed surface 104 is isolated from the heat to lower the temperature of the exposed surface 104.

An exhaust 250 exhausts combusted air from the combustion chamber enclosure 105 to the outside.

The fireplace 100 further includes a touch switch system to turn the fireplace 100 on and off. The touch switch system includes a touch panel 300, shown in FIG. 1 and in phantom lines in FIG. 2, and a control circuit 305, shown in FIG. 2. Insulation 310 can be used to thermally isolate the touch panel 300 from the heat generated by the fireplace 100 and, thus, reduce the temperature of the touch panel 300. Insulation 310 can be any type of material that isolates the touch panel 300 such as ceramic materials, Teflon, or other insulative materials. The insulation 310 need not reduce the temperature to ambient or room temperature, but, typically, reduces the temperature to a level that lowers the risk of injury to an individual that touches the touch panel. Alternatively, the touch panel can be cooled with other devices such as fans or blowers.

The touch panel 300 includes a touch portion 315 corresponding to all or a portion of the exposed surface 104 of the fireplace 100. In the embodiment shown in FIGS. 1 and 2, the touch portion 315 is only a portion of the exposed surface 104. Any exposed surface of any fireplace can be used to provide access to the touch portion 315. Touch portion 315 is located at a top portion 106 of the exposed surface 104. Alternatively, the touch portion can be located along the bottom, sides, or on any other portion of the exposed surface.

The touch portion 315 includes a conductive material that is electrically isolated from the rest of the fireplace 100. The touch portion 315 can be constructed to differentiate the touch portion 315 from the rest of the fireplace 100 so that a user may easily identify it. For example, the touch portion 315 can be a metallic color or include an emblem, a company logo, or a brand name that sets the touch portion 315 apart from the exposed surface 104. Insulation 310 reduces the temperature of the touch portion 315 to allow an individual to touch the fireplace 100 at that location without injury.

A first wire 320 connects the touch panel 300 to the control circuit 305. Alternatively, the touch panel and control circuit can be constructed as a single unit or coupled through a remote or wireless connection. The control circuit 305 can be any circuit configured to sense a change, signal, or disruption at the touch portion 315. For example, control circuit 305 can be constructed to sense the presence of an AC voltage at the touch portion 315. One such control circuit can be purchased from Ramsey Electronic, Inc., located in Victor, N.Y. (product identification: TS1-Touch Switch Kit). The sensitivity at the touch portion 315 can be altered by modifying control circuit 305, such as the TS1-Touch Switch Kit. Optionally, a potentiometer can be included in the input circuit of control circuit 305 to increase sensitivity.

As a user of the fireplace 100 contacts the touch portion 315, the hum and noise that has been pick-up by the user such as AC voltage from power lines increases the voltage input into the control circuit 305. The input voltage travels from the touch panel 300 through the first wire 320 and to the control circuit 305. The input of voltage to the control circuit 305 results in the control circuit 305 generating an output that can switch the state of various components of the fireplace 100. Alternatively, other touch control systems can be used, such as systems that measure capacitance, resistance, conduction, induction, temperature, etc.

Control circuit 305 can be connected to another part of the fireplace to drive a relay that, for example, turns the fireplace gas on and off through the gas valve 249. The output of the control circuit 305 can be coupled to control the gas valve 249 through a second wire 330, or alternatively, through a remote or wireless connection that does not include a wired connection. Alternatively, the control circuit can be used to drive other components or features of the fireplace such as, for example, increasing or decreasing gas flame height, altering the speed of a blower or fan, turning a simulated ember bed of a fireplace on and off, and controlling motors or lights in an electric fireplace.

In alternative embodiments, the touch panel can be located in hidden or viewable positions on a fireplace mantel. In other embodiments, the touch panel can form all or a portion of a decorative or trimmable surround of the fireplace. In yet other embodiments, multiple touch panels can be used to drive multiple components or features of the fireplace.

Figure 3:
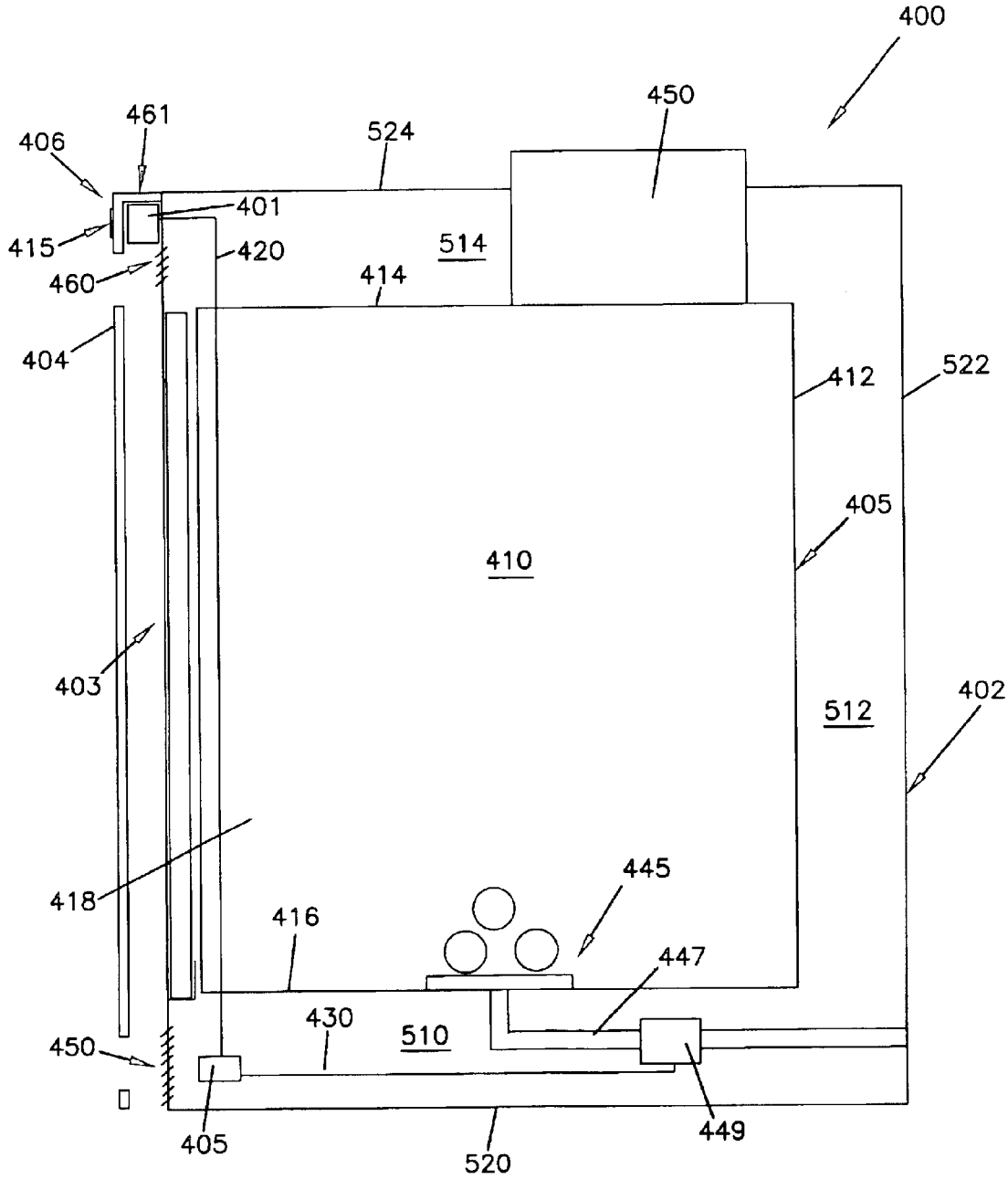
FIG. 3 is a cross-sectional view of a second embodiment of an example fireplace including a second example embodiment of a touch switch system made in accordance with the present invention.

Referring to FIG. 3, a cross-sectional view of a second example embodiment of a fireplace 400 including a second example embodiment of a touch switch system is shown. Fireplace 400 includes an outer enclosure 402, a front panel 403, grills 450 and 460, and a combustion chamber enclosure 405. The combustion chamber enclosure 405 comprises front panel 403 and panels 412, 414, 416, and 418 that together with a second side panel (not shown) define a combustion chamber 410. Fireplace 400 also includes a burner 445 that is coupled by a gas line 447 to a source of combustible gas (not shown). A gas valve 449 regulates the amount of gas flowing to burner 445. Exhaust 450 exhausts combusted air and gas from the fireplace 400.

Fireplace 400 includes a lower plenum 510, a rear plenum 512, and a top plenum 514 positioned between outer panels 520, 522, and 524 and the combustion chamber enclosure 105.

The touch switch system includes an activation panel 401 and a control circuit 405, as shown, for example, in FIG. 3. A surround 461 is positioned in front of front panel 403. Surround 461 can be used to provide decoration and/or have a functional purpose such as to direct heat or house components such as the touch switch system. Surround 461 can be made from ceramic materials, wood, plastic, other desired non-metallic material, or combinations of those materials. Surround 461 can be any structure placed in front off or attached to the front panel 403. For example, as an alternative to surround 461, a trim or other non-metallic facade can be placed in front off or be attached to the front panel of the fireplace.

The activation panel 401 is located behind the surround 461 and is thereby prefereably removed from view. The surround 461 includes an activation portion 415 corresponding to all or a portion of the exposed surface 404 of the surround 461. The activation portion 415 is coupled to the control circuit 405 through, for example, activation panel 410.

Surround 461 can be used to thermally isolate the activation portion 415 from the heat generated by the fireplace 400 and, thus, reduce the temperature of the activation portion 415. For example, as shown in FIG. 3, surround 461 can be spaced apart from front panel 403 to reduce the temperature of activation portion 415. Alternatively, the surround can be formed with insulative material such as a compression or vacuum molded material containing a ceramic fiber and binder. The surround 461 need not reduce the temperature to ambient or room temperature, but, preferably, reduces the temperature to a level that lowers the risk of injury to an individual that comes near the activation portion 415. Alternatively, the activation portion can be cooled with other devices such as fans or blowers.

In the embodiment shown in FIG. 3, the activation portion 415 is only a portion of the exposed surface 404. Any exposed surface of any fireplace can be used to provide access to the activation portion 415. Activation portion 415 is located at a top portion 406 of the exposed surface 404. Alternatively, the activation portion can be located along the bottom, sides, or on any other portion of the exposed surface.

The activation panel 401 includes a conductive material that is electrically isolated from the rest of the fireplace 400. The activation portion 415 can be constructed to differentiate the activation portion 415 from the rest of the fireplace 400 so that a user may easily identify it. For example, the activation portion 415 can be a metallic color, stained to a color different than the remainder of the fireplace surround, or include an emblem, a company logo, or a brand name that sets the activation portion 415 apart from the exposed surface 404. The activation portion 415 only needs to direct a user of the fireplace to put a hand, or other portion of their body, near or in contact with the surround 461 to result in a change in the operation of the fireplace 400. Activation portion 415 can be any material, such as the material that forms surround 461.

In the example touch switch system of FIG. 3, the activation portion 415 is not connected to the activation panel 401 through direct electrical contact. The activation portion 415 is located on the exposed surface 404 of the surround 461 with the surround 461 creating the space between the activation portion 415 and the activation panel 401.

A first wire 420 connects the activation panel 401 to the control circuit 405. Alternatively, the activation panel and control circuit can be constructed as a single unit (activation module) or coupled through a remote or wireless connection. The control circuit 405 can be any circuit configured to sense a change, signal, or disruption at the activation portion 415. For example, control circuit 405 can be constructed to sense a change in capacitance between the activation panel 401 and a ground. One such control circuit can be purchased from Quantum Research Group Ltd., located in Pittsburgh, Pa. (product identification: QT110). The sensitivity at the activation portion 415 can be altered by modifying control circuit 405, such as the QT110.

As a user of the fireplace 400 contacts or nears the control circuit 405 with, for example, a hand, the control circuit 405 senses a change in capacitance at the activation panel 401. This change in capacitance is measured from activation panel 401 through first wire 420. If the capacitance change measured by control circuit 405 is great enough, the control circuit 405 can generate an output that can switch the state of various components of the fireplace 400. The user need not physically touch the activation portion 415 to generate a capacitance change sufficient to cause the control circuit to switch the state of a fireplace component. Alternatively, other touch control systems can be used, such as systems that measure voltage, resistance, conduction, induction, temperature, etc.

Control circuit 405 can be connected to another part of the fireplace to drive a relay that, for example, turns the fireplace gas on and off through the gas valve 449. The output of the control circuit 405 can be coupled to control the gas valve 449 through a second wire 430, or alternatively, through a remote or wireless connection -that does not include a wired connection. Alternatively, the control circuit can be used to drive other components or features of the fireplace such as, for example, increasing or decreasing gas flame height, altering the speed of a blower or fan, turning a simulated ember bed of a fireplace on and off, and controlling motors or lights in an electric fireplace.

Alternative to the location shown in FIG. 3, an activation panel can be located in a position similar to touch panel 300 of FIG. 2 with the surround positioned as shown in FIG. 3. In this configuration, as the user of the fireplace nears an activation portion of an exposed surface of a front panel, the operation of the fireplace can be altered.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A gas fireplace comprising:

a burner disposed to combust a combustible gas and air mixture within a combustion chamber enclosure;

a surround positioned adjacent to a front panel, wherein the surround defines an exposed surface;

an activation portion of the exposed surface;

an activation panel spaced apart from the activation portion, the activation panel sensing a change in capacitance;

a gas valve; and a control circuit coupled to the activation portion and gas valve, wherein the control circuit monitors the activation portion and controls the opening and closing of the gas valve in response to a change at the activation portion.

2. The gas fireplace of claim 1, wherein the surround comprises a compression molded ceramic material.

3. A method for turning a gas fireplace on and off, the method comprising the steps of:

providing an activation portion of an exposed surface of the fireplace;

coupling the activation portion to a control circuit through an activation panel;

monitoring a capacitance at the activation panel with the control circuit; and turning combustion in a combustion chamber of the fireplace on or off in response to a change in capacitance at the activation panel.

4. The method of claim 3, wherein the step of turning the fireplace on or off in response to the change in capacitance at the activation panel comprises a step of changing a position of a gas valve in response to a signal from the control circuit to regulate a flow of combustible gas to a burner.

* * * * *